US009052084B2

(12) United States Patent
Lin et al.

(10) Patent No.: US 9,052,084 B2
(45) Date of Patent: Jun. 9, 2015

(54) BEAM GENERATING DEVICE

(71) Applicant: MSI COMPUTER (SHENZHEN) CO., LTD, Shenzhen, Guangdong Province (CN)

(72) Inventors: Yi-Feng Lin, New Taipei (TW); Hung-Chou Chen, New Taipei (TW)

(73) Assignee: MSI COMPUTER (SHENZHEN) CO., LTD., Shenzhen (CN)

( * ) Notice: Subject to any disclaimer, the term of this patent is extended or adjusted under 35 U.S.C. 154(b) by 114 days.

(21) Appl. No.: 13/904,570

(22) Filed: May 29, 2013

(65) Prior Publication Data

US 2014/0211480 A1 Jul. 31, 2014

(30) Foreign Application Priority Data

Jan. 31, 2013 (CN) ..... 2013 1 0041714

(51) Int. Cl.

| | |
|---|---|
| ***F21V 7/00*** | (2006.01) |
| ***F21V 33/00*** | (2006.01) |
| *F21W 131/40* | (2006.01) |
| *F21Y 101/02* | (2006.01) |

(52) U.S. Cl.

CPC ..... *F21V 7/0025* (2013.01); *F21V 7/00* (2013.01); *F21V 33/0076* (2013.01); *F21V 7/0008* (2013.01); *F21V 7/0091* (2013.01); *F21W 2131/40* (2013.01); *F21Y 2101/02* (2013.01)

(58) Field of Classification Search

USPC ..... 250/492.1, 492.3

See application file for complete search history.

(56) References Cited

U.S. PATENT DOCUMENTS

2014/0140096 A1* 5/2014 Van Bommel et al. ..... 362/609

FOREIGN PATENT DOCUMENTS

WO 2013-008221 * 1/2013

* cited by examiner

*Primary Examiner* — Ashok Patel

(74) *Attorney, Agent, or Firm* — Birch, Stewart, Kolasch & Birch, LLP

(57) ABSTRACT

A beam generating device emitting a first beam and a second beam and including a luminescence unit and a first reflecting unit is disclosed. The luminescence unit emits a main beam. The first reflecting unit reflects the main beam to generate a first reflected beam. The main beam forms the first beam and the first reflected beam forms the second beam.

7 Claims, 11 Drawing Sheets

BEAM GENERATING DEVICE

CROSS REFERENCE TO RELATED APPLICATIONS

This Application claims priority of China Patent Application No. 201310041714.2, filed on Jan. 31, 2013, the entirety of which is incorporated by reference herein.

BACKGROUND OF THE INVENTION

1. Field of the Invention

The invention relates to a beam generating device, and more particularly, to a device capable of generating two beams.

2. Description of the Related Art

Beams are widely used in industry, like the food and aerospace industries, in a home, for a security system, and in businesses. Generally, a conventional beam generator comprises various luminescence units to emit various beams. However, requirement for the luminescence units increase costs and power consumption of the conventional beam generator.

BRIEF SUMMARY OF THE INVENTION

An exemplary embodiment of a beam generating device emits a first beam and a second beam and comprises a luminescence unit and a first reflecting unit. The luminescence unit emits a main beam. The first reflecting unit reflects the main beam to generate a first reflected beam. The main beam forms the first beam and the first reflected beam forms the second beam.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
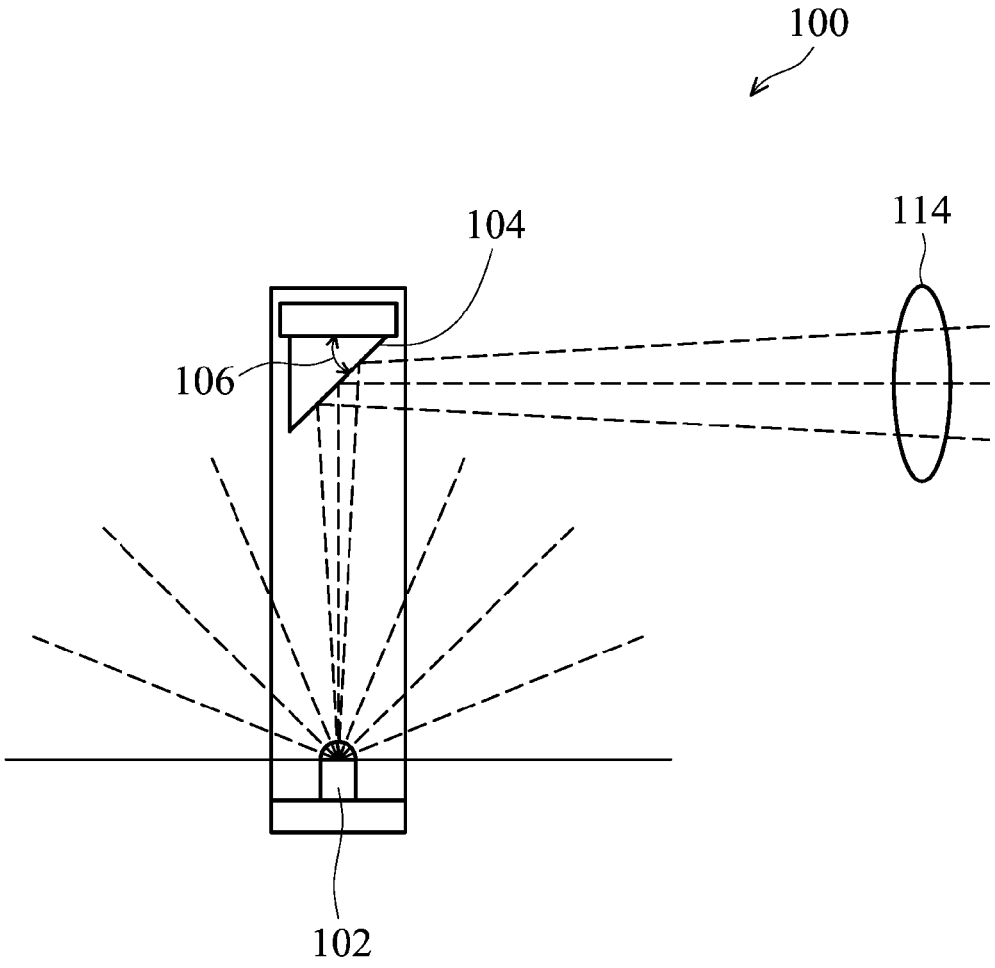
FIG. 1A is a schematic diagram of an exemplary embodiment of a beam generating device.

FIG. 1A is a schematic diagram of an exemplary embodiment of a beam generating device. The beam generating device 100 comprises a luminescence unit 102 and a reflecting unit 104. The luminescence unit 102 emits a main beam 112. In one embodiment, the main beam 112 is visible or invisible. Additionally, the invention does not limit the kinds of the luminescence unit 102. In one embodiment, the luminescence unit 102 is an emitter to emit infrared beam (IR) or a beam-emitting diode.

The reflecting unit 104 reflects the main beam 112 to generate a reflected beam 114. In this embodiment, the reflecting unit 104 is a mirror and has an angle 106. The invention does not limit the range of the angle 106. In one embodiment, the angle 106 is approximately 45°.

Figure 1B:
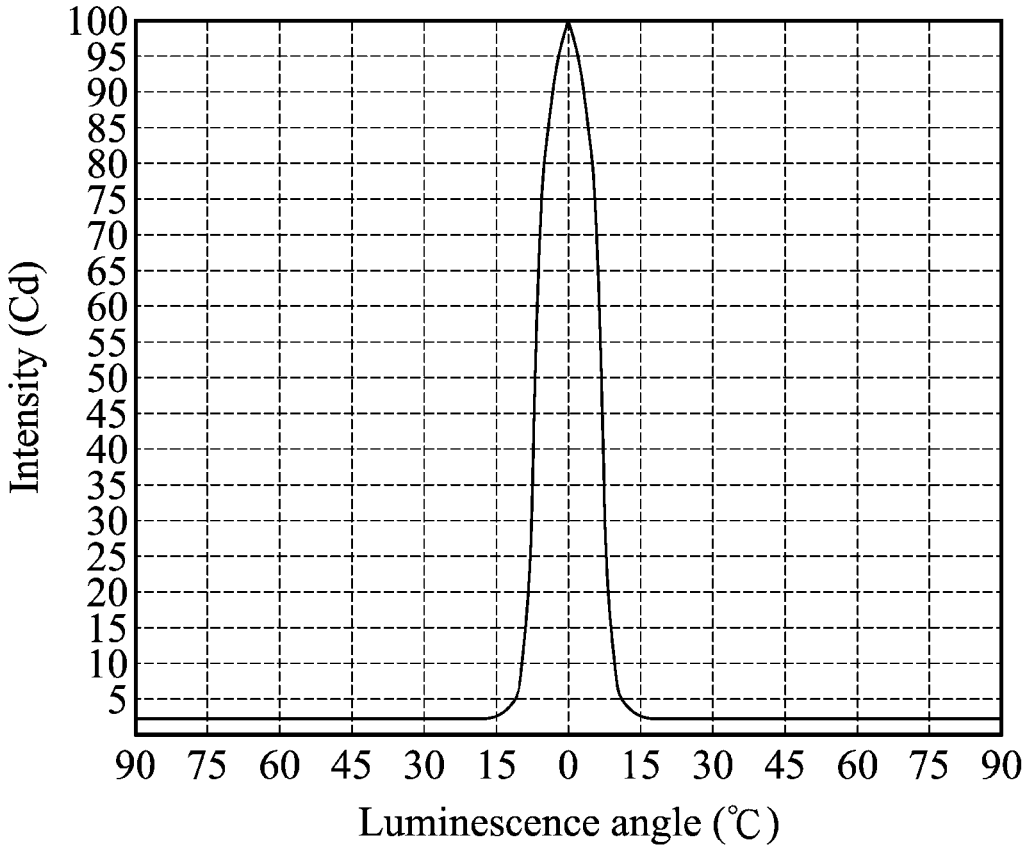
FIG. 1B is a characteristic diagram of the luminescence unit.

FIG. 1B is a characteristic diagram of the luminescence unit. When a luminescence angle of the luminescence unit 102 is approximately 0°, the beam emitted from the luminescence unit 102 has a maximum intensity. Thus, in this embodiment, the reflecting unit 104 is disposed on top of the luminescence unit 102 to reflect the maximum beam. When the luminescence angle of the luminescence unit 102 increases, the intensity of the beam is reduced such that a circular beam is generated.

Figure 1C:
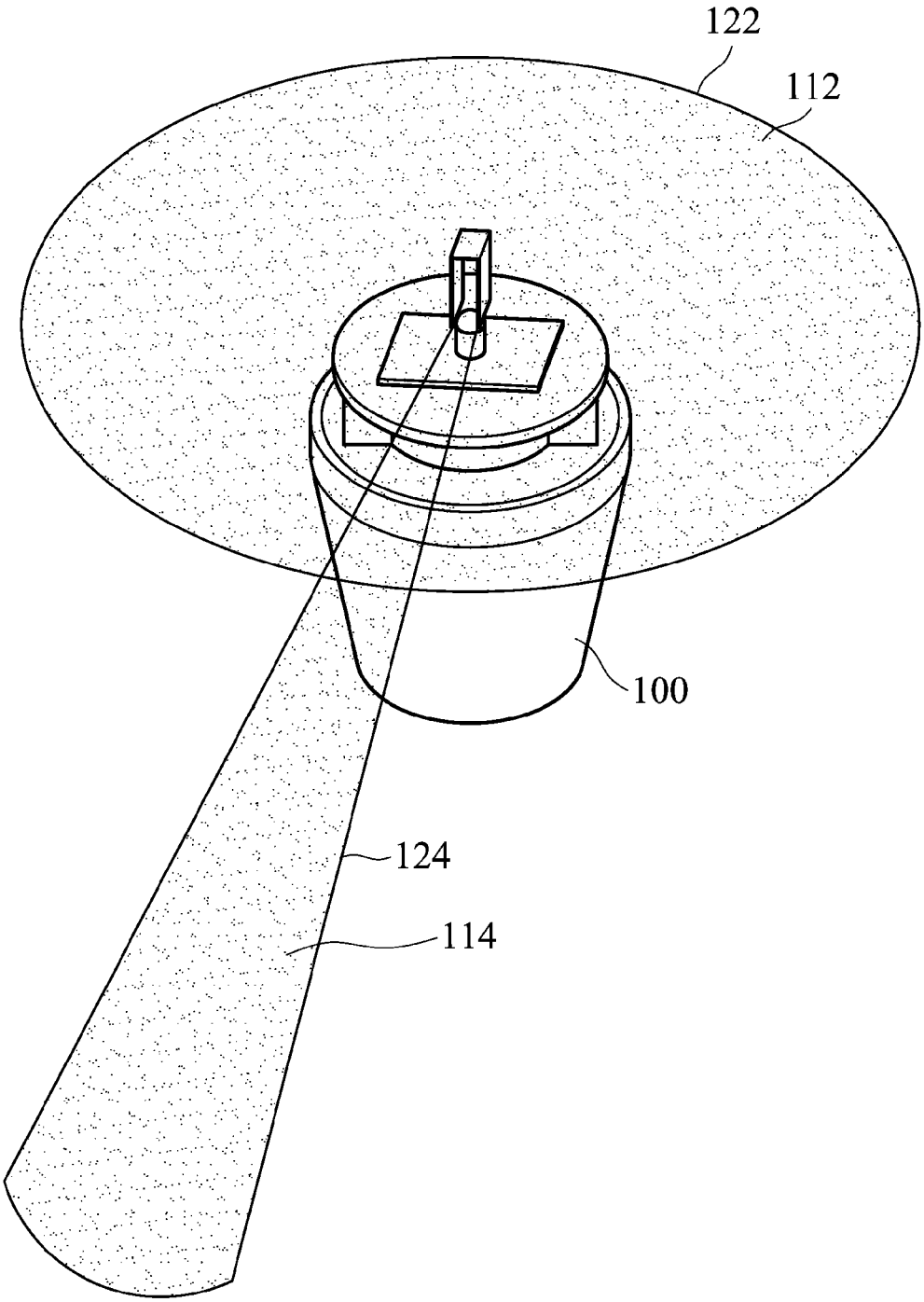
FIGS. 1C, 2C and 3C are top views of other exemplary embodiments of a main beam and a reflected beam.

FIG. 1C is a top view of the main beam and the reflected beam. The beam generating device 100 provides a first beam 122 and a second beam 124. In this embodiment, the main beam 112 is served as the first beam 122 and the reflected beam 114 is served as the second beam 124. The first beam 122 is emitted from the luminescence unit 102. The first beam 122 is not a reflected beam. The invention does not limit the shape of the beams. In this embodiment, the first beam 122 is a circular beam and the second beam 124 is a straight beam.

Figure 2A:
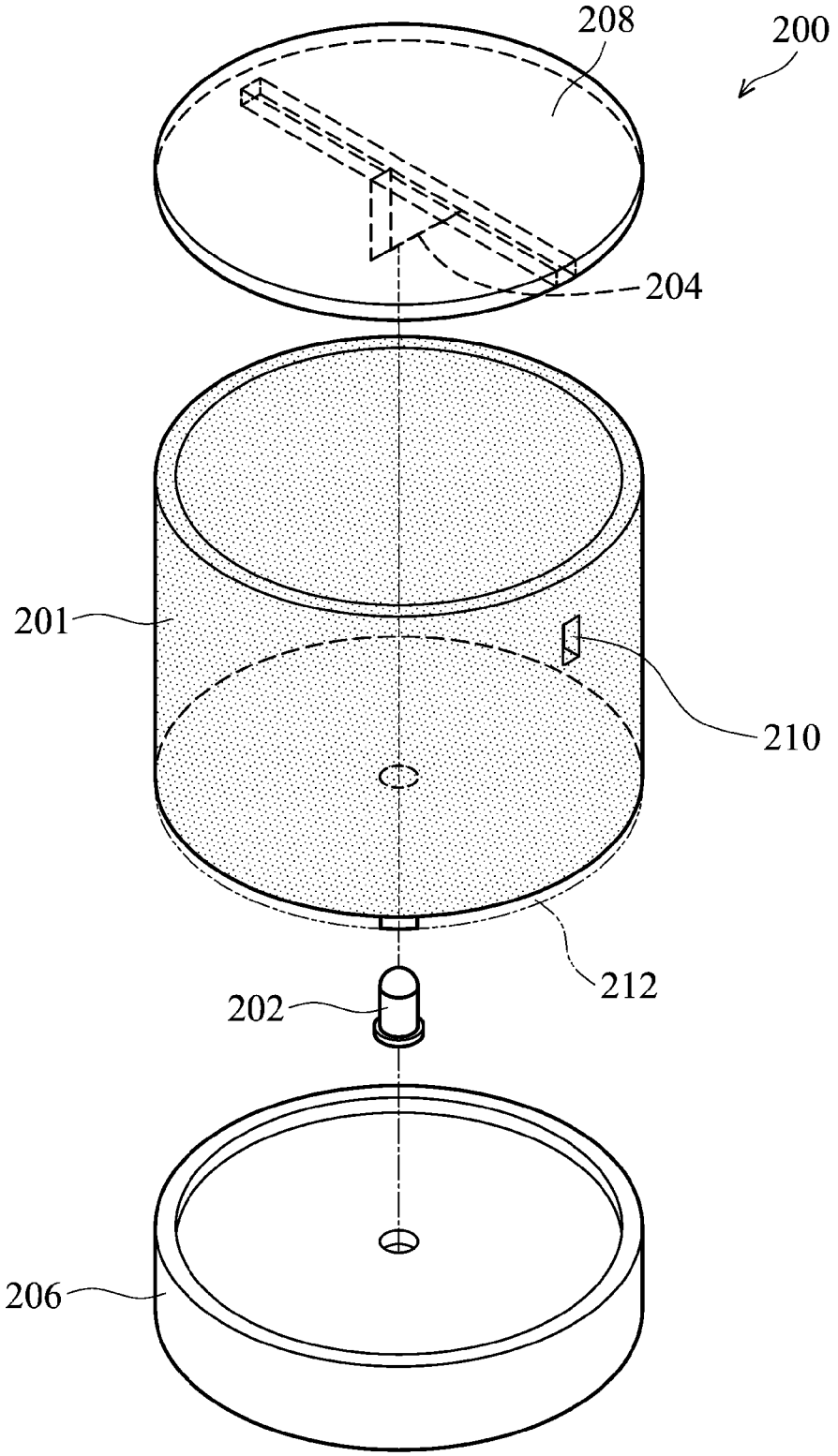
FIGS. 2A, 3A and 4A are schematic diagrams of other exemplary embodiments of the beam generating device.

FIG. 2A is a schematic diagram of another exemplary embodiment of the beam generating device. FIG. 2A is similar to FIG. 1A with the exception that the beam generating device 200 further comprises a tube 201. The tube 201 is an opaque tube. In this embodiment, the tube 201 contains the luminescence unit 202 and the reflecting unit 204. The luminescence unit 202 is fixed in a base 206. The reflecting unit 204 is fixed in a base 208. Since the luminescence units 102 and 202 have the same principle as previously mentioned and the reflecting units 104 and 204 have the same principle as previously mentioned, descriptions of the luminescence unit 202 and the reflecting unit 204 are omitted for brevity.

When the tube 201 connects to the base 206, a slit 212 is formed. The main beam emitted from the luminescence unit 202 passes through the slit 212 to form a first beam. In this embodiment, the tube 201 further comprises another slit 210. The reflected beam provided by the reflecting unit 204 passes through the slit 210 to form a second beam. In one embodiment, the shape of the slit 210 is square.

Figure 2B:
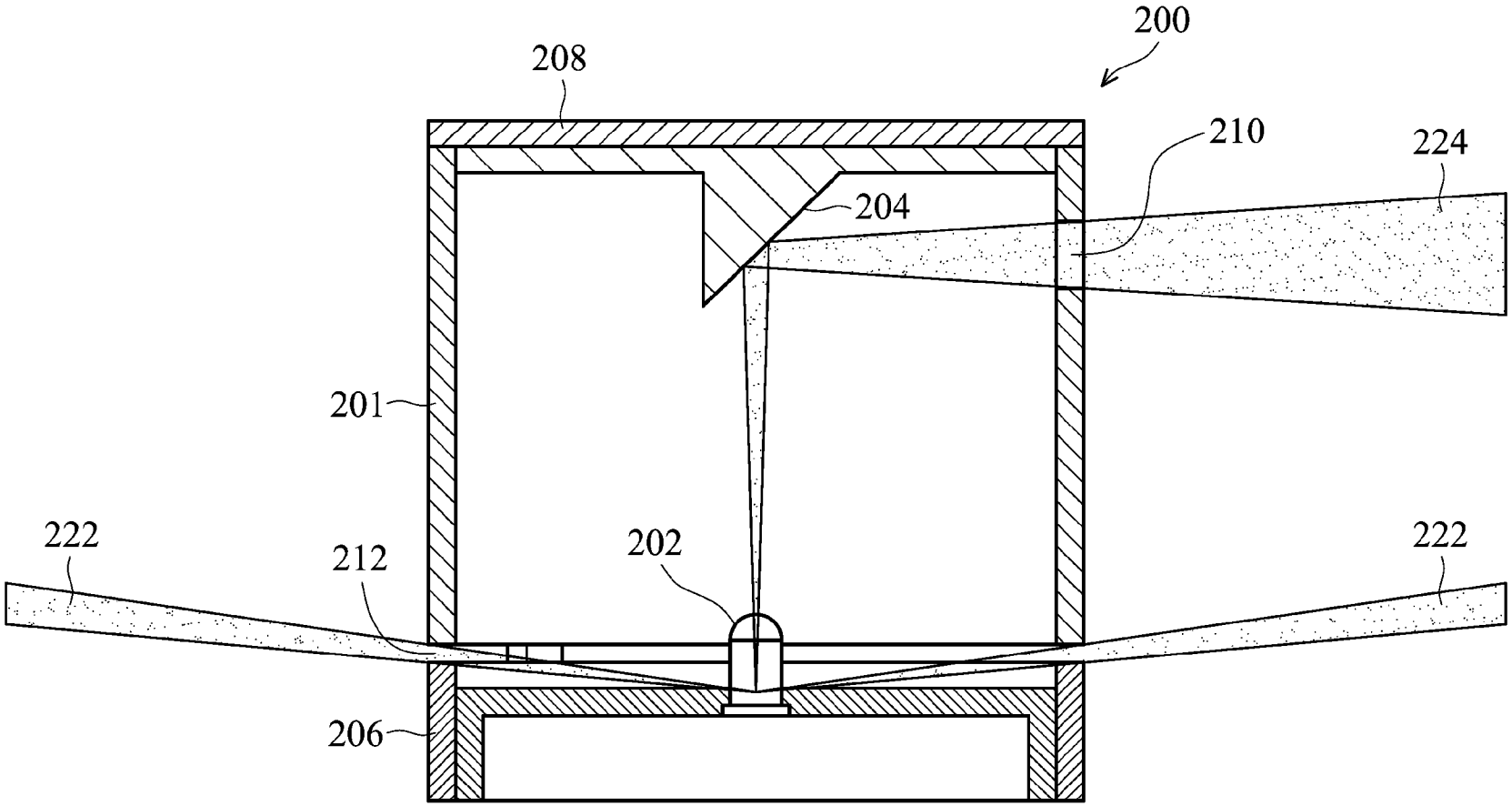
FIGS. 2B, 3B and 4B are combination diagrams of other exemplary embodiments of the beam generating device.

FIG. 2B is a combination diagram of an exemplary embodiment of the beam generating device. The main beam generated by the luminescence unit 202 passes through the slit 212 to form a beam 222. The reflecting unit 204 reflects the main beam to generate a reflected beam. The reflected beam passes through the slit 210 to form a beam 224.

Figure 2C:
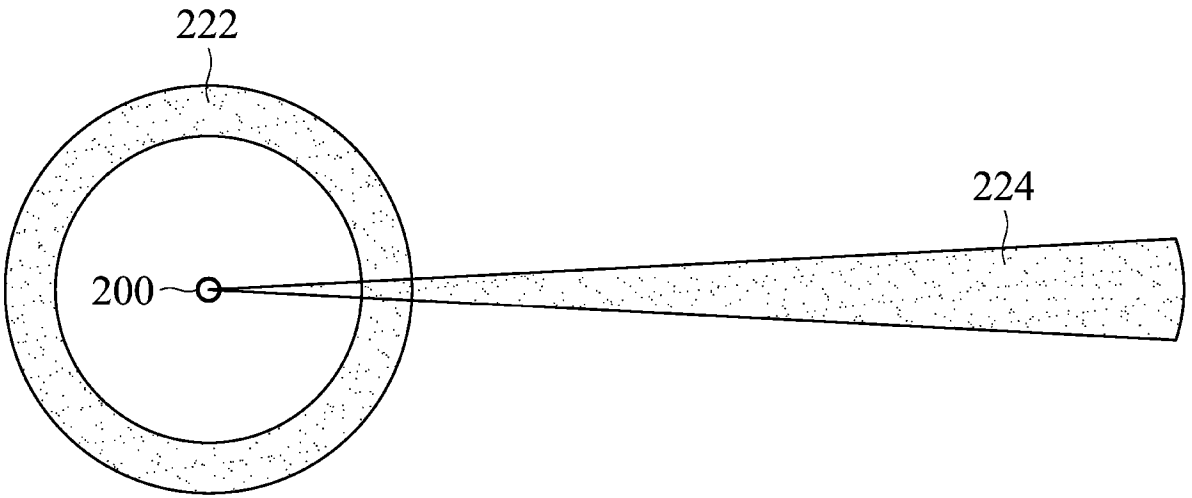

FIG. 2C is a schematic diagram of an exemplary embodiment of the beams 222 and 224 generated by the beam generating device 200. The beam 224 passing through the slit 212 is a straight beam and the beam 222 passing through the slit 210 is a ring-like beam. In this embodiment, the beam 222 is directly emitted from the luminescence unit 202. The beam 222 is not reflected by any object.

In one embodiment, at least one of the size and the position of the slit 210 is controlled to adjust the width and the height of the beam 224. Additionally, the size of the slit 212 is controlled to adjust the cover range of the beam 222. In other embodiments, the angle of the reflecting unit 204 is controlled to adjust the width and the position of the beam 224.

Figure 3A:
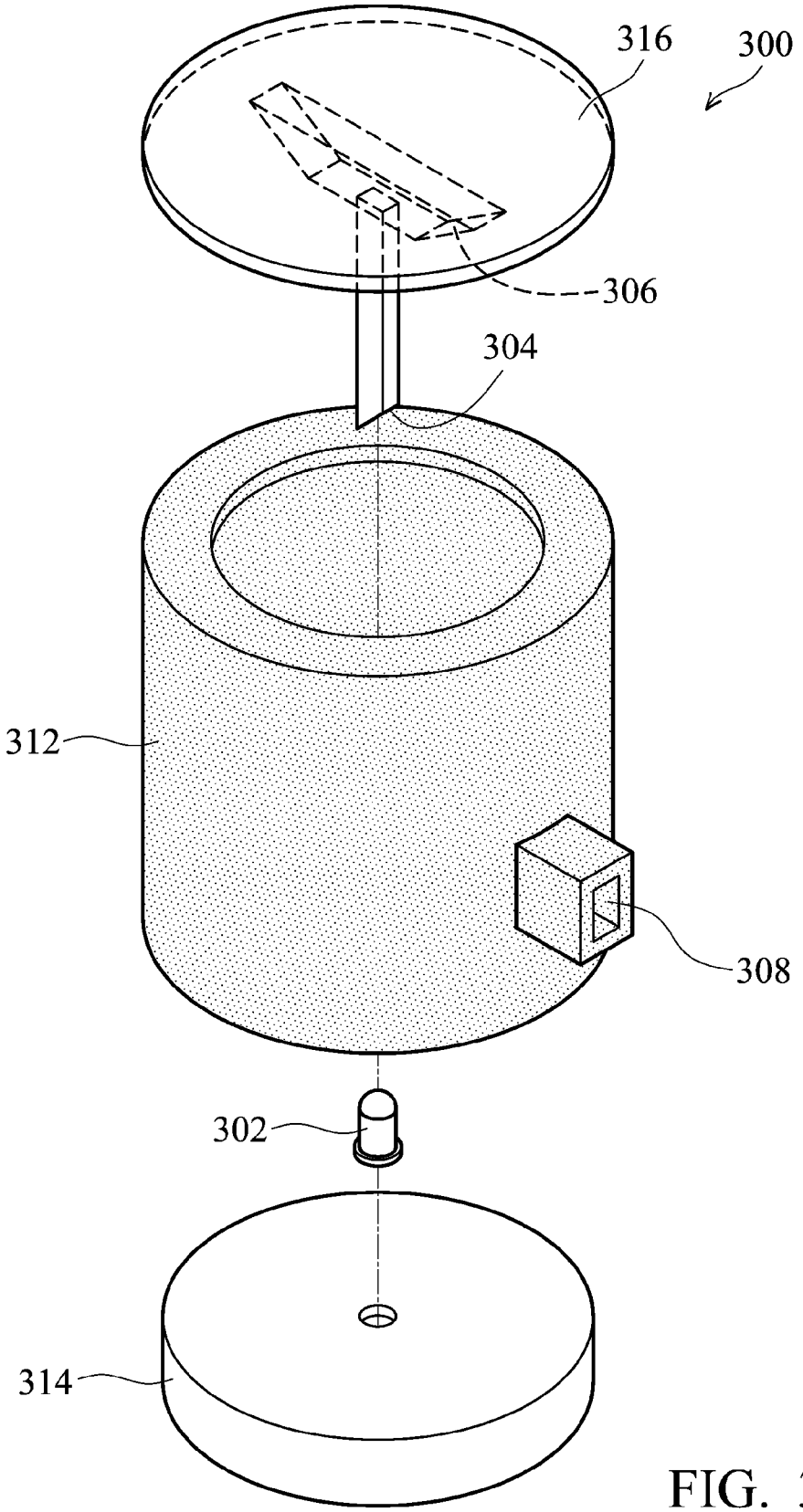

FIG. 3A is a schematic diagram of another exemplary embodiment of the beam generating device. FIG. 3A is similar to FIG. 2A with the exception that the beam generating device 300 further comprises a reflecting unit 306. As shown in FIG. 3A, the luminescence unit 302, the reflecting units 304 and 306 are contained in the tube 312. In this embodiment, the tube 312 is an opaque tube. The luminescence unit 302 is fixed in the base 314. The reflected unit 304 is connected to the reflected unit 306. The reflected unit 306 is fixed in the base 314.

In this embodiment, when the tube 312 connects to the base 314, no gap is generated between the tube 312 and the base 314. When the tube 312 connected to the base 316, a gap is generated between the tube 312 and the base 316 and the gap is served as the slit 310. The reflected unit 306 reflects the main beam emitted from the luminescence unit 302 to generate a reflected beam. In this embodiment, the reflected beam generated by the reflecting unit 306 passes through the slit 310 to form a first beam. The invention does not limit the kind of the reflected unit 306. In one embodiment, the reflecting unit 306 is a conical mirror.

The reflecting unit 304 reflects the main beam emitted from the luminescence unit 302 to generate a reflected beam. In this embodiment, the reflected beam generated by the reflecting unit 304 passes through the slit 308 to form a second beam. In this embodiment, the slit 308 is a protruding slit protruding through the surface of the tube 312. The protruding slit 308 increases the linearity of the second beam. In another embodiment, the slit 308 is a plane slit. The plane slit does not protrude through the surface of the tube 312.

Figure 3B:
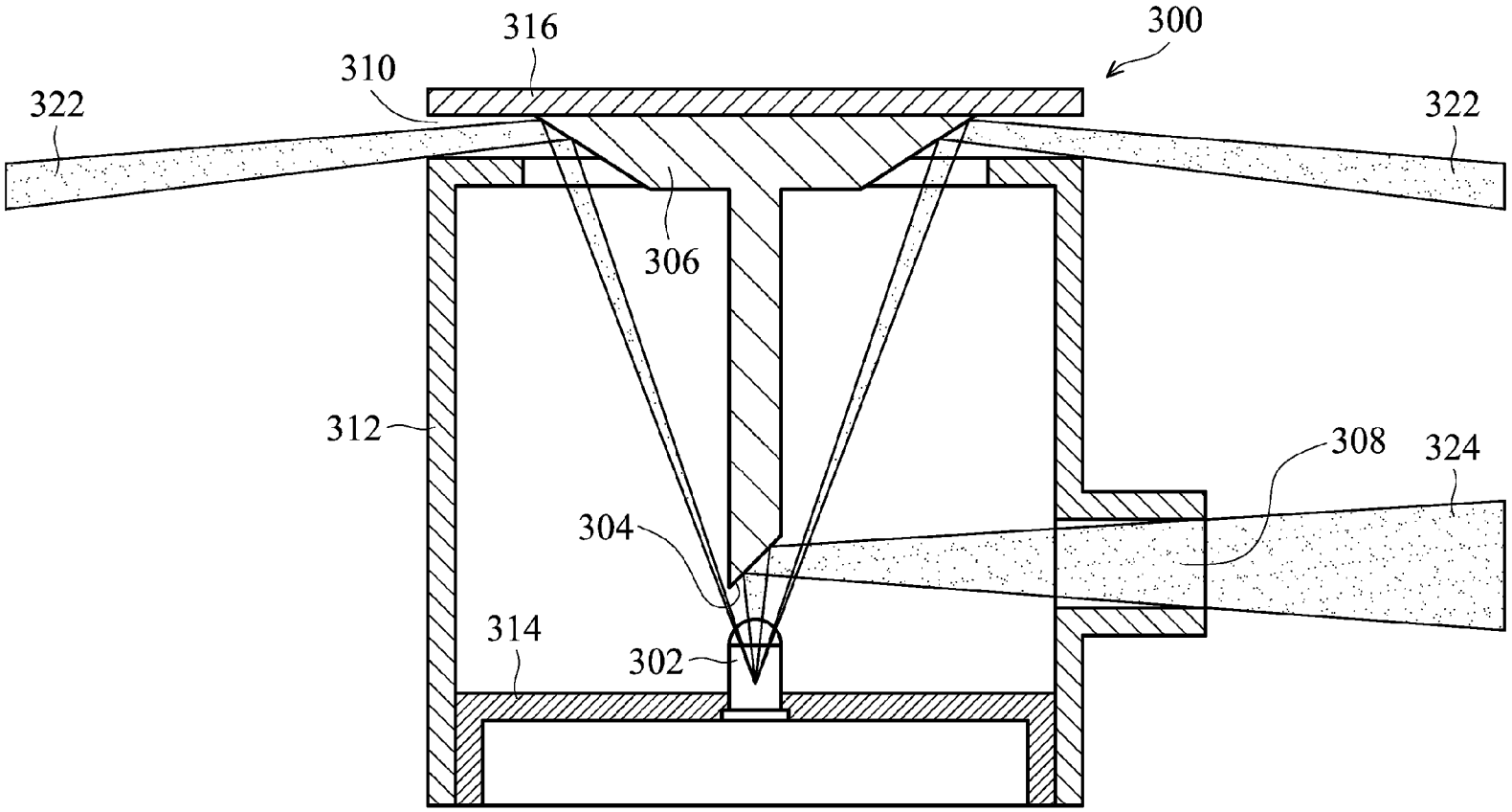

FIG. 3B is a combination diagram of an exemplary embodiment of the beam generating device 300. The reflecting unit 306 reflects the main beam generated by the luminescence unit 302 to generate a first reflected beam. In this embodiment, the first reflected beam passes through the slit 310 and forms a beam 322. Furthermore, the reflecting unit 304 reflects the main beam to generate a second reflected beam. The second reflected beam passes through the slit 308 and forms a beam 324.

Figure 3C:
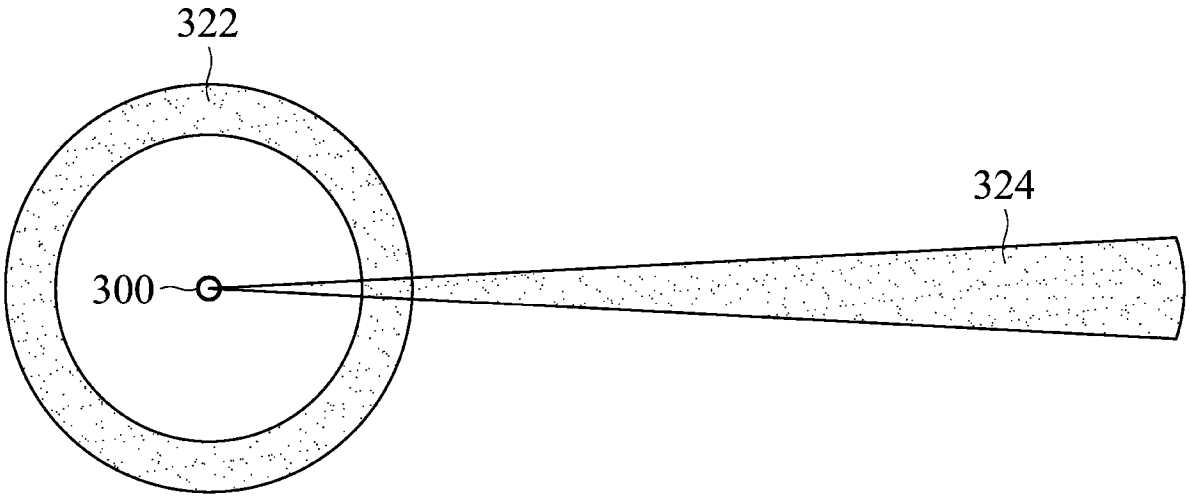

FIG. 3C is a schematic diagram of another exemplary embodiment of the first and the second beams generated by the beam generating device 300. The beam 324 passing through the slit 308 is a straight beam. The beam 322 passing through the slit 310 is a ring-like beam. In one embodiment, at least one of the size and the position of the slit 308 is controlled to adjust the width and the height of the beam 324. In other embodiments, the angle of the reflecting unit 304 or 306 is controlled to adjust the width and the position of the beams 324 and 322.

Figure 4A:
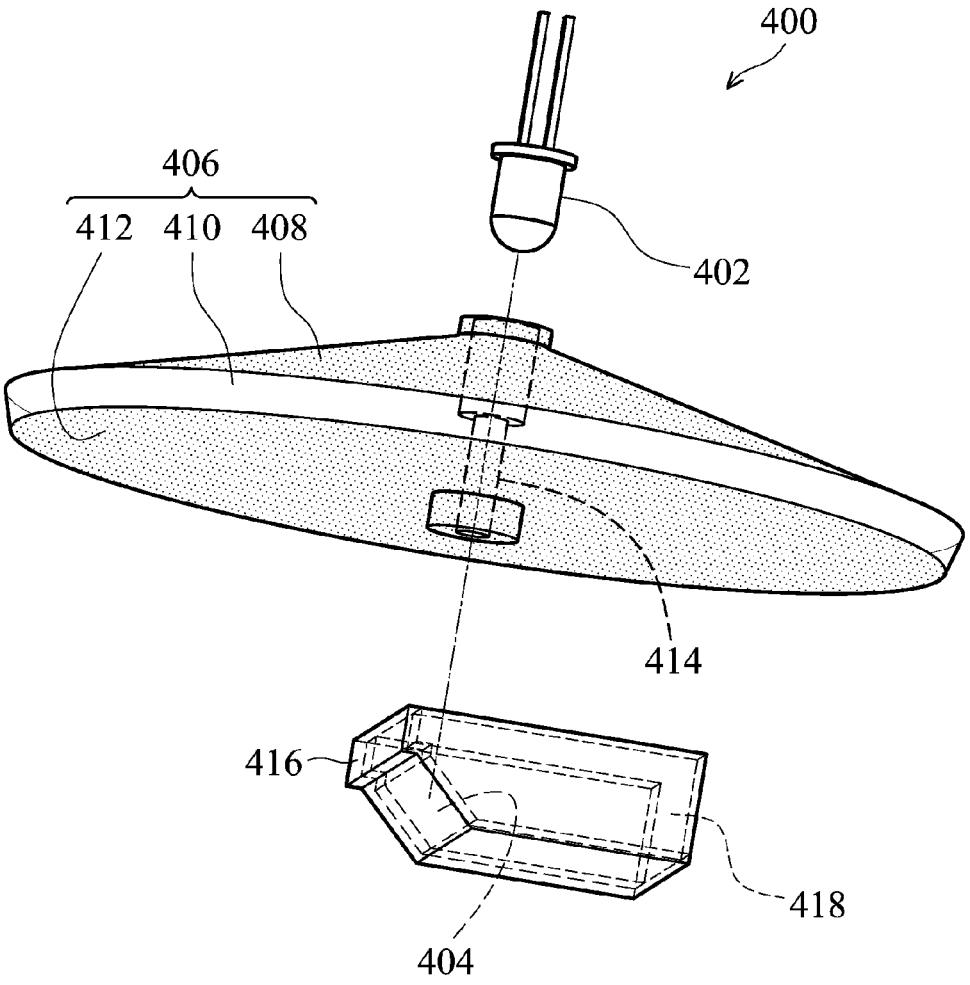

FIG. 4A is a schematic diagram of another exemplary embodiment of a beam generating device. The beam generating device 400 further comprises components 406 and 416. The luminescence unit 402 is disposed in the component 406. The reflecting unit 404 is disposed in the component 416. Since the luminescence units 402 and 102 have the same principle and the reflecting units 404 and 104 have the same principle, descriptions of the luminescence unit 402 and the reflecting unit 404 are omitted for brevity.

The component 406 comprises opaque layers 408, and 412, a transparent layer 410 and a hole 414. In one embodiment, a top surface and a bottom surface of a transparent plastic slice are processed such that the top surface and the bottom surface of the transparent plastic slice are opaque. In one embodiment, the top surface and the bottom surface of the transparent plastic slice are electroplated to form the opaque layers 408 and 412. A middle layer between the top surface and the bottom surface of the transparent plastic slice is served as the transparent layer 410. The invention does not limit the shape of the component 406. In this embodiment, the shape of the top surface 408 of the component 406 is a conical shape and the shape of the bottom surface 412 of the component 406 is a plane shape.

The opaque layer 408, the transparent layer 410 and the opaque layer 412 are successively arranged. The luminescence unit 402 is disposed in the hole 414. The main beam emitted from the luminescence unit 402 passes through the transparent layer 410 and the beam passing through the transparent layer 410 forms a first beam.

Since the top and the bottom surfaces of the component 406 are opaque, the main beam only passes through the transparent layer 410 and forms a first beam. The width of the transparent layer 410 is controlled to adjust the size of the first beam. In this embodiment, the first beam is a ring-like beam. Additionally, the first beam is directly emitted from the luminescence unit 402. The first beam is not reflected by any object.

The component 416 closely connects to the component 406. The reflecting unit 404 is disposed in the component 416 to reflect the main beam emitted by the luminescence unit 402. In this embodiment, the reflecting unit 404 is disposed to aim the hole 414 and reflect the main beam emitted by the luminescence unit 402. The reflected beam generated by the reflecting unit 404 passes through the slit 418. The beam passing through the slit 418 forms a second beam. The size of the slit 418 is controlled to adjust the width and the height of the second beam. In one embodiment, the second beam is a straight beam.

Figure 4B:
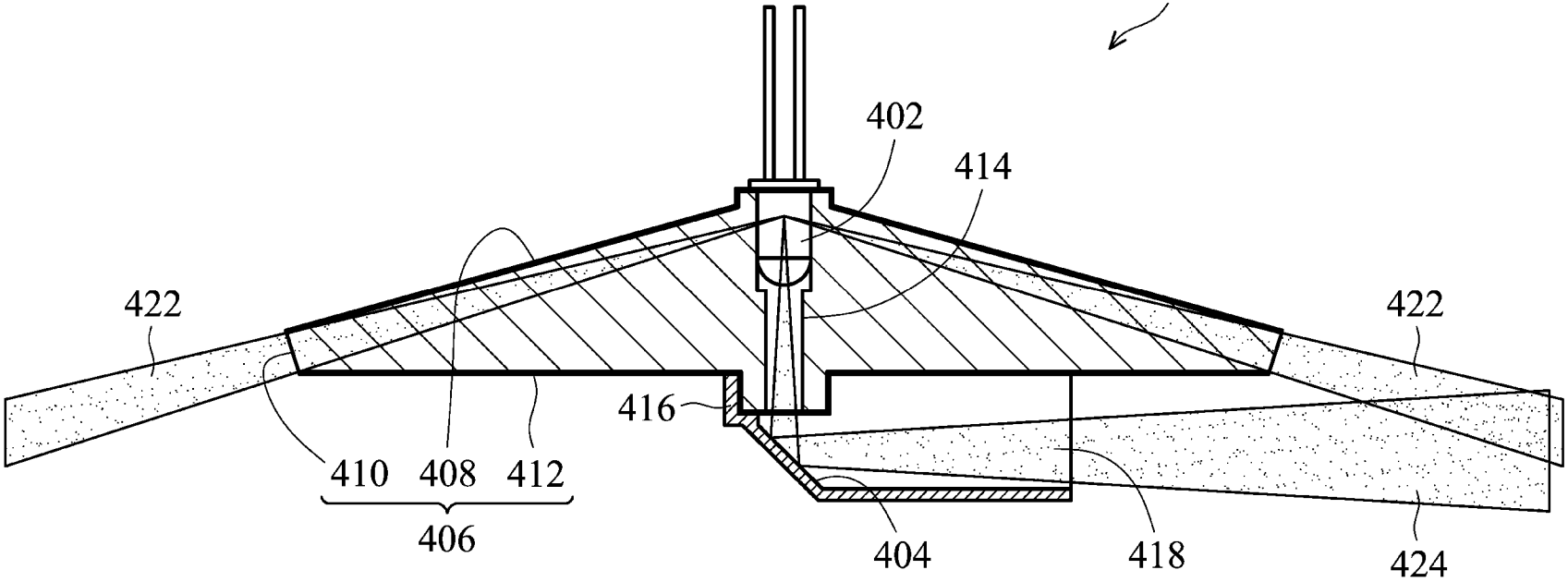

FIG. 4B is a combination diagram of an exemplary embodiment of the beam generating device 400. The main beam generated by the luminescence unit 402 passes through the transparent layer 410. The beam passing through the transparent layer 410 forms the beam 422. Additionally, the reflecting unit 404 reflects the main beam to generate a reflected beam. The reflected beam passes through the slit 418. The beam passing through the slit 418 forms the beam 424.

In summary, the beam generating device of the invention only utilizes a single luminescence unit to provide two beams. Thus, the cost for the element and power consumption are reduced. Furthermore, the size of the slit is controlled to adjust the dimension of the beam passing through the slit.

The invention does not limit the field for applying the beam generating device. Any field can utilize the beam generating device, as long as the field utilizes at least one beam to control other elements. In one embodiment, the beam generating device is a virtual wall, a lighthouse or a docking station to control the traveling path of a cleaning robot.

For example, the first beam, such as a circular beam or a ring-like beam, generated by the beam generating device is utilizing to serve as a crashworthy beam. The cleaning robot does not collide with the beam generating device according to the crashworthy beam. Additionally, the second beam, such as a straight beam, generated by the beam generating device is utilized to serve as a guiding beam or a stop beam. The guiding beam leads the cleaning robot to a specific area. The stop beam leads the cleaning robot to avoid entering a specific area.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A beam generating device emitting a first beam and a second beam, comprising:

a luminescence unit emitting a main beam;

a first reflecting unit reflecting the main beam to generate a first reflected beam, wherein the main beam forms the first beam and the first reflected beam forms the second beam; and a tube containing the luminescence unit and the first reflecting unit and comprising a first slit and a second slit, wherein the main beam passes through the first slit to form the first beam and the first reflected beam passes through the second slit to form the second beam, wherein the first beam is a ring-like beam and the second beam is a straight beam.

2. A beam generating device emitting a first beam and a second beam, comprising:

a luminescence unit emitting a main beam;

a first reflecting unit reflecting the main beam to generate a first reflected beam, wherein the main beam forms the first beam and the first reflected beam forms the second beam;

a second reflecting unit reflecting the main beam to form a second reflected beam; and a tube containing the luminescence unit, the first and the second reflecting units and comprising a first slit and a second slit, wherein the second reflected beam passes through the first slit to form the first beam and the first reflected beam passes through the second slit to form the second beam, wherein the first beam is a ring-like beam and the second beam is a straight beam.

3. The beam generating device as claimed in claim 2, wherein the second reflected unit is a conical mirror.

4. A beam generating device emitting a first beam and a second beam, comprising:

a luminescence unit emitting a main beam;

a first reflecting unit reflecting the main beam to generate a first reflected beam, wherein the main beam forms the first beam and the first reflected beam forms the second beam;

a first component comprising a first layer, a second layer, a third layer and a hole, wherein the hole passes through the first, the second and the third layers, the first, the second and the third layers are successively arranged, the first and the third layers are opaque, the luminescence unit is disposed in the hole and the main beam passes through the second layer to form the first beam; and a second component containing the first reflecting unit and comprising a slit, wherein the first reflecting unit aims the hole to reflect the main beam to form the first reflected beam and the first reflected beam passes through the second beam, wherein the first beam is a ring-like beam and the second beam is a straight beam.

5. The beam generating device as claimed in claim 4, wherein a shape of the first layer is a conical shape and a shape of the third layer is a plane shape.

6. The beam generating device as claimed in claim 4, wherein the first and the third layers are electroplated.

7. The beam generating device as claimed in claim 4, wherein the second layer is a transparent layer.

* * * * *